US008254615B2

(12) United States Patent
Schultz

(10) Patent No.: US 8,254,615 B2
(45) Date of Patent: Aug. 28, 2012

(54) LOUDSPEAKER WITH ACOUSTIC SPEAKER LENS

(76) Inventor: Ricky David Schultz, Barrhead (CA)

( * ) Notice: Subject to any disclaimer, the term of this patent is extended or adjusted under 35 U.S.C. 154(b) by 509 days.

(21) Appl. No.: 12/576,437

(22) Filed: Oct. 9, 2009

(65) Prior Publication Data

US 2011/0085691 A1 Apr. 14, 2011

(51) Int. Cl.
*H04R 1/20* (2006.01)

(52) U.S. Cl. ..... 381/343; 381/340; 381/339

(58) Field of Classification Search ..... 381/337–343, 381/423, 424; 181/152, 159, 160, 177, 185, 181/187, 192–196
See application file for complete search history.

(56) References Cited

U.S. PATENT DOCUMENTS

| | | | | |
|---|---|---|---|---|
| 4,164,631 | A * | 8/1979 | Garner et al. | 381/340 |
| 2007/0223729 | A1* | 9/2007 | Hoglund | 381/89 |
| 2008/0013768 | A1* | 1/2008 | Hayashi | 381/337 |
| 2008/0128199 | A1* | 6/2008 | Magalotti | 181/185 |

* cited by examiner

*Primary Examiner* — Tuan Nguyen
(74) *Attorney, Agent, or Firm* — Weingarten, Schurgin, Gagnebin & Lebovici LLP

(57) ABSTRACT

For a loudspeaker with a cabinet and a driver cone, an acoustic speaker lens may be positioned on the driver cone. The acoustic speaker lens may include a center post and a plurality of ribs extending radially outward from the center post. The acoustic speaker lens may reduce turbulence in air in front of the loudspeaker, thereby leading to an improved perception of audio reproduction.

21 Claims, 10 Drawing Sheets

LOUDSPEAKER WITH ACOUSTIC SPEAKER LENS

FIELD

The present application relates generally to audio reproduction and, more specifically, to a loudspeaker with an acoustic speaker lens.

BACKGROUND

In the world of high-end audio, it appears that every improvement in audio reproduction, however small, is welcome. Accordingly, research is ongoing into every aspect of audio reproduction performed by various elements of audio equipment. From the power provided to the equipment to the room in which the output of the equipment is enjoyed, no potential degradation is ignored.

A common method to reproduce sound waves from a loudspeaker involves the use of a cone connected to a coil-magnet drive system. Cones that are low in mass may be seen to respond quickly to small or high-frequency signals. Further, cones that are also stiff may be seen to prevent deflection of the cone during the forward and rearward vibration movement that creates sound pressure waves. This may be seen as beneficial in that deflection of the cone is considered to produce distortion. To combine low mass and stiffness in a single cone, the cone is typically shaped like a horn, since the horn shape has been shown to provide a stronger, less flexible structure than a flat membrane.

The horn shape, however, means that vibrations from the cone produce a wavefront that does not originate from a single point source. Further, the horn shape may be shown to lead to pressure waves that are concentrated towards a central focal point of the horn shape.

SUMMARY

For a loudspeaker with a cabinet and a driver cone, an acoustic speaker lens may be positioned on the driver cone. The acoustic speaker lens may include a center post and a plurality of ribs extending radially outward from the center post. The acoustic speaker lens may be shown to change the shape of the pressure wavefront emanating from the driver cone, reduce turbulence of air in front of the loudspeaker and, thereby, lead to a more coherent and linear pressure wavefront. This more coherent and linear pressure wavefront may be perceived as resulting in more accurate sound reproduction.

According to an aspect of the present disclosure, there is provided a loudspeaker including a cabinet defining an aperture, a driver cone mounted within the aperture and an acoustic speaker lens positioned on the driver cone. The acoustic speaker lens includes a center post and a plurality of ribs extending radially outward from the center post.

In one embodiment, the ribs are of similar shape and diameter. In an alternate embodiment, the ribs are of varying shape and diameter/size. In further embodiments, the diameter of adjacent ribs gradually decrease to form a cone shape or, inversely gradually decrease to form an inverted cone shape. Furthermore, elements of the acoustic speaker lens may be perforated or vented to further control air flow or minimize resonances within the acoustic lens itself.

According to another aspect of the present disclosure, there is provided a loudspeaker including a cabinet defining an aperture, a driver cone mounted within the aperture, the driver cone molded to include an acoustic speaker, the acoustic speaker lens including: a center post; and a plurality of ribs extending radially outward from the center post.

According to a further aspect of the present disclosure, there is provided a loudspeaker including a cabinet defining an aperture, a driver cone mounted within the aperture, the driver cone molded to include an acoustic speaker, the acoustic speaker lens including: a center post; and a helical rib extending radially outward from the center post.

Other aspects and features of the present invention will become apparent to those of ordinary skill in the art upon review of the following description of specific embodiments of the invention in conjunction with the accompanying figures.

BRIEF DESCRIPTION OF THE DRAWINGS

Reference will now be made to the drawings, which show by way of example, embodiments of the present disclosure, and in which.

DETAILED DESCRIPTION OF THE EMBODIMENTS

Figure 1:
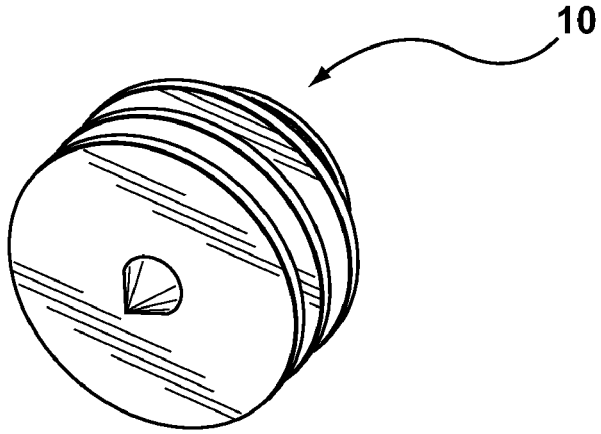
FIG. 1 illustrates a perspective view of an acoustic speaker lens according to an embodiment of the present disclosure.
Figure 2:
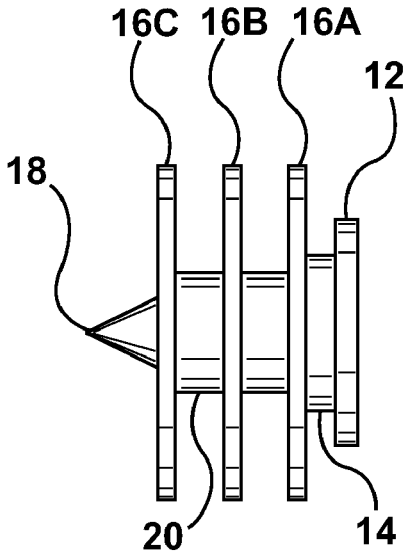
FIG. 2 illustrates a side view of the acoustic speaker lens of FIG. 1.
Figure 3:
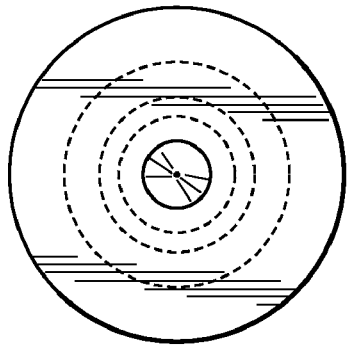
FIG. 3 illustrates a front end view of the acoustic speaker lens of FIG. 1.
Figure 4:
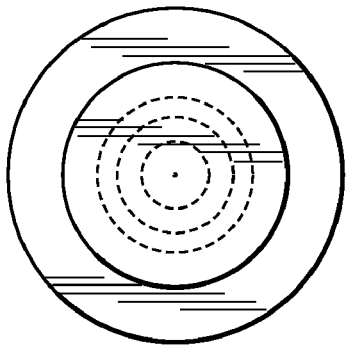
FIG. 4 illustrates a back end view of the acoustic speaker lens of FIG. 1.

FIG. 1 illustrates a perspective view of an acoustic speaker lens 10 according to an embodiment of the present disclosure. An example structure for the acoustic speaker lens 10 is more clearly illustrated in a side view illustrated in FIG. 2.

The acoustic speaker lens 10 includes a center post 20. Extending radially outward from the center post are three discs: a rear rib 16A; a middle rib 16B; and a front rib 16C (collectively or individually referenced by reference numeral 16). The acoustic speaker lens 10 includes a base 12 used, as will be discussed, for connecting the acoustic speaker lens 10 to a driver cone for a loudspeaker. The base 12 is separated from the rear disc by a base post 14.

Positioned with a base on the front of the front rib 16C, a cone-shaped center point 18 tapers to an apex distal from the front rib 16C. The center point 18 is an optional feature of the acoustic speaker lens 10 and may be of varying shapes, surface textures, and materials.

In one embodiment, the acoustic speaker lens may be carved out of a single block comprising a mix of plastic, canvas and epoxy. While experiments have, thus far, been conducted using an acoustic speaker lens formed from a piece of Aluminum, the Applicants surmise that further improvements may be realized with using less dense materials, such as wood, plastic or other materials which effectively reduce the mass of the acoustic speaker lens, with reduced mass leading to improved speaker cone response and acceleration.

Figure 5:
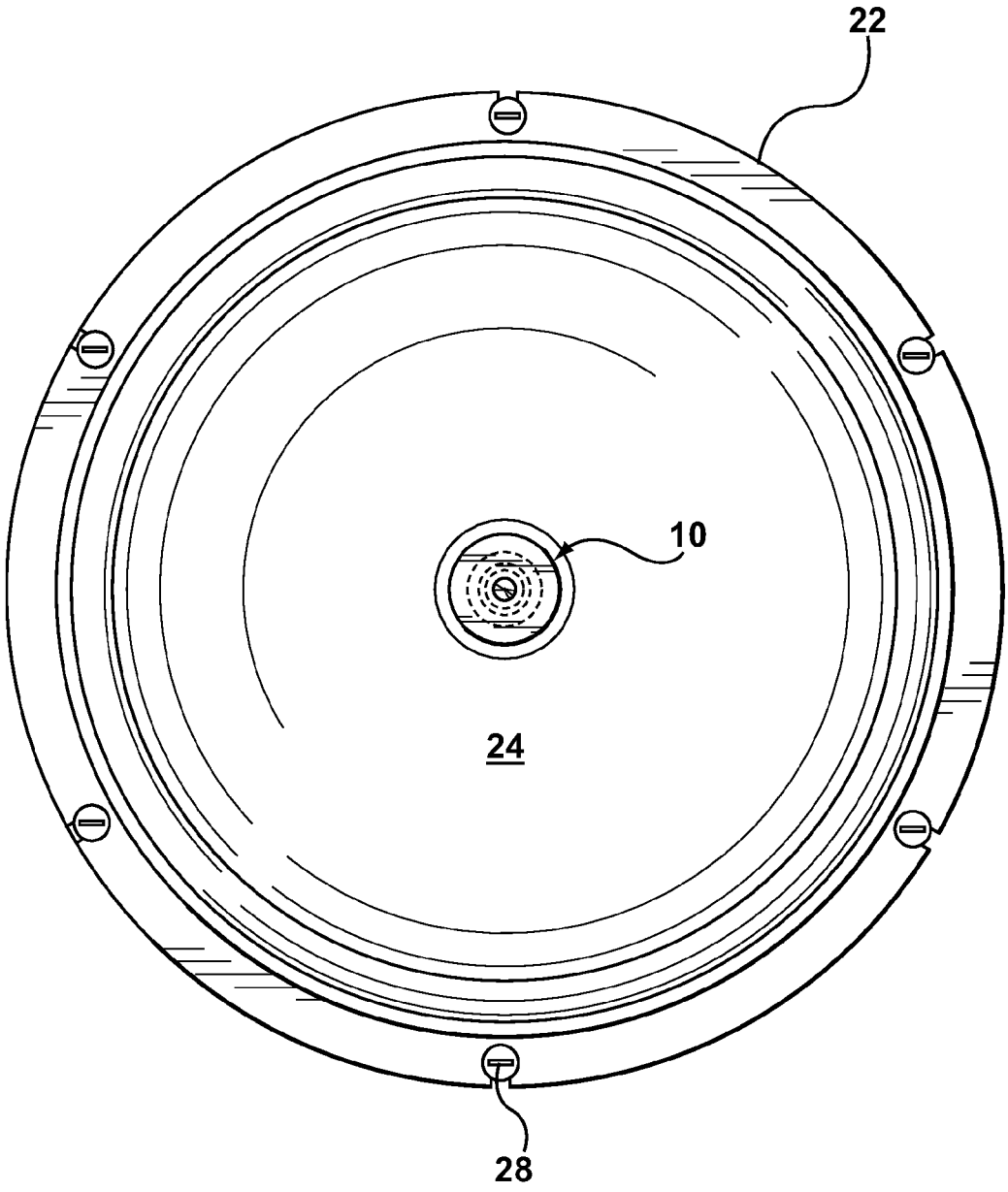
FIG. 5 illustrates a front view of a loudspeaker on which the acoustic speaker lens of FIG. 1 has been mounted.

FIG. 5 illustrates the acoustic speaker lens 10 mounted to a loudspeaker 40. The elements of the loudspeaker 40 include a speaker cabinet 26. Mounted within an aperture in the speaker cabinet 26 is a concave speaker basket 30. The concave speaker basket 30 attaches to the speaker cabinet 26 around the periphery of the aperture though the use of fastening elements, such as driver attachment screws 28. The driver attachment screws 28 also secure a concave driver cone 24 to the speaker cabinet 26 within the aperture and in front of the speaker basket 30. The speaker basket 30 suspends a speaker magnet 32 within the interior of the speaker cabinet 26.

A voice coil 34 (consisting of a bobbin, a collar and a winding, not individually referenced) is the coil of wire attached at the apex of the driver cone 24 of the loudspeaker 40. As will be known to a person of skill in the art, the voice coil 34 provides motive force to the driver cone 24 by the reaction of a magnetic field to the current passing through it.

By driving a varying current through the voice coil 34, a varying magnetic field is produced. The varying magnetic field causes the voice coil 34 to react to the magnetic field from the speaker magnet 32 fixed, by way of the speaker basket 30, to the speaker cabinet 26, thereby moving the driver cone 24. By applying an audio waveform to the voice coil 34, the driver cone 24 will reproduce sound pressure waves that correspond to an original input signal used to produce the audio waveform.

Figure 6:
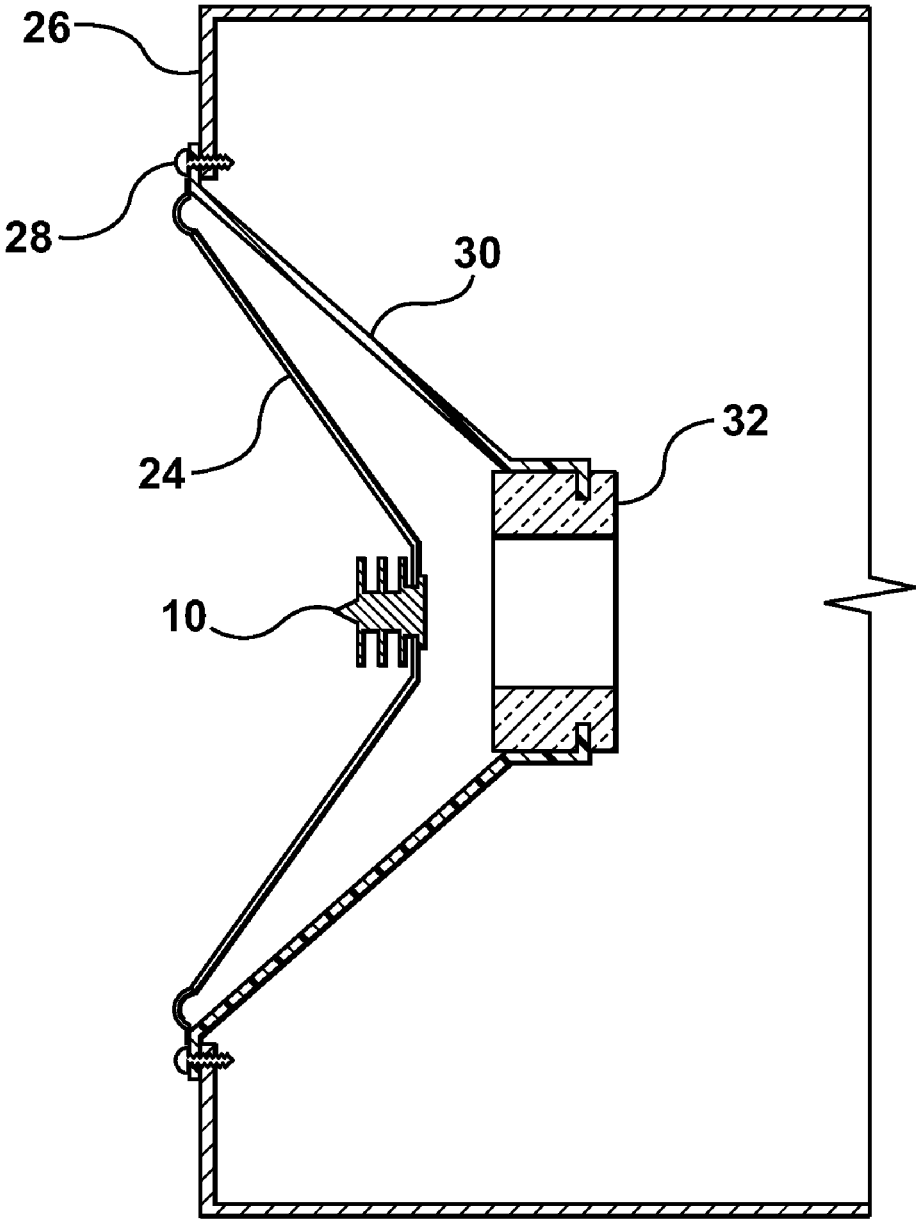
FIG. 6 illustrates a sectional view of the loudspeaker of FIG. 5, taken along section line A:A in FIG. 5.

In operation, the base 12 of the acoustic speaker lens 10 may be fastened to the driver cone 24. In one aspect, an adhesive may be used to affix the acoustic speaker lens 10 to the driver cone 24. In another aspect, the acoustic speaker lens 10 may be received by an aperture in the driver cone 24, as illustrated in the sectional view of the loudspeaker 40 in FIG. 6. In another aspect, the acoustic speaker lens 10 may be molded into the driver cone 24 so that an acoustic speaker lens and driver cone would be a single solid unit. Furthermore, the acoustic speaker lens 10 may be attached to the driver cone 24 by a mechanical fastener, such as a screw (not shown) or a clamp (not shown).

The Applicants have recognized that the driver cone 24 tapers backward and in towards the center of the voice coil 34. The Applicants surmise that energy collected in the driver cone 24 through interaction with the voice coil 34 forces a pressure wavefront towards a focal point in front of the driver cone 24. Unfortunately, such a concentration of pressure at the focal point may be seen to create turbulence or a distorted wavefront in a manner that is unfavorable for sound reproduction.

By fastening the acoustic speaker lens 10 to the driver cone 24, the Applicants expect that the manner in which the driver cone 24 propagates a pressure wavefront is altered. Heuristically, the Applicants have found a subjective improvement in the sound reproduction by the loudspeaker 40 with the acoustic speaker lens 10 when compared with an equivalent loudspeaker without the acoustic speaker lens 10.

While the acoustic speaker lens 10 illustrated in FIGS. 1-10 has three radially extending ribs 16, other design possibilities exist. Indeed the diameter of the ribs may be increased or decreased. Similarly, the number of ribs may be increased or decreased. Furthermore, the orientation of the ribs may be altered. In an alternate embodiment, ribs (not shown) extend longitudinally along the center post 20. Many properties of the acoustic speaker lens 10 may be matched to the driver cone on which the acoustic speaker lens 10 is to be mounted. A larger acoustic speaker lens may be seen to be more effective on a larger driver cone than a smaller acoustic speaker lens.

In a further alternate embodiment, the center post 20 may be vented with a plurality of apertures. More particularly, an aperture in a side of the center post 20 may be connected, via channel, to an aperture in an end of the center post 20.

Manners in which the acoustic speaker lens 10 may be mounted to a driver cone in a pre-existing loudspeaker have been discussed above. However, not all loudspeakers have a structure represented by the loudspeaker 40 of FIGS. 5 and 6.

Figure 7:
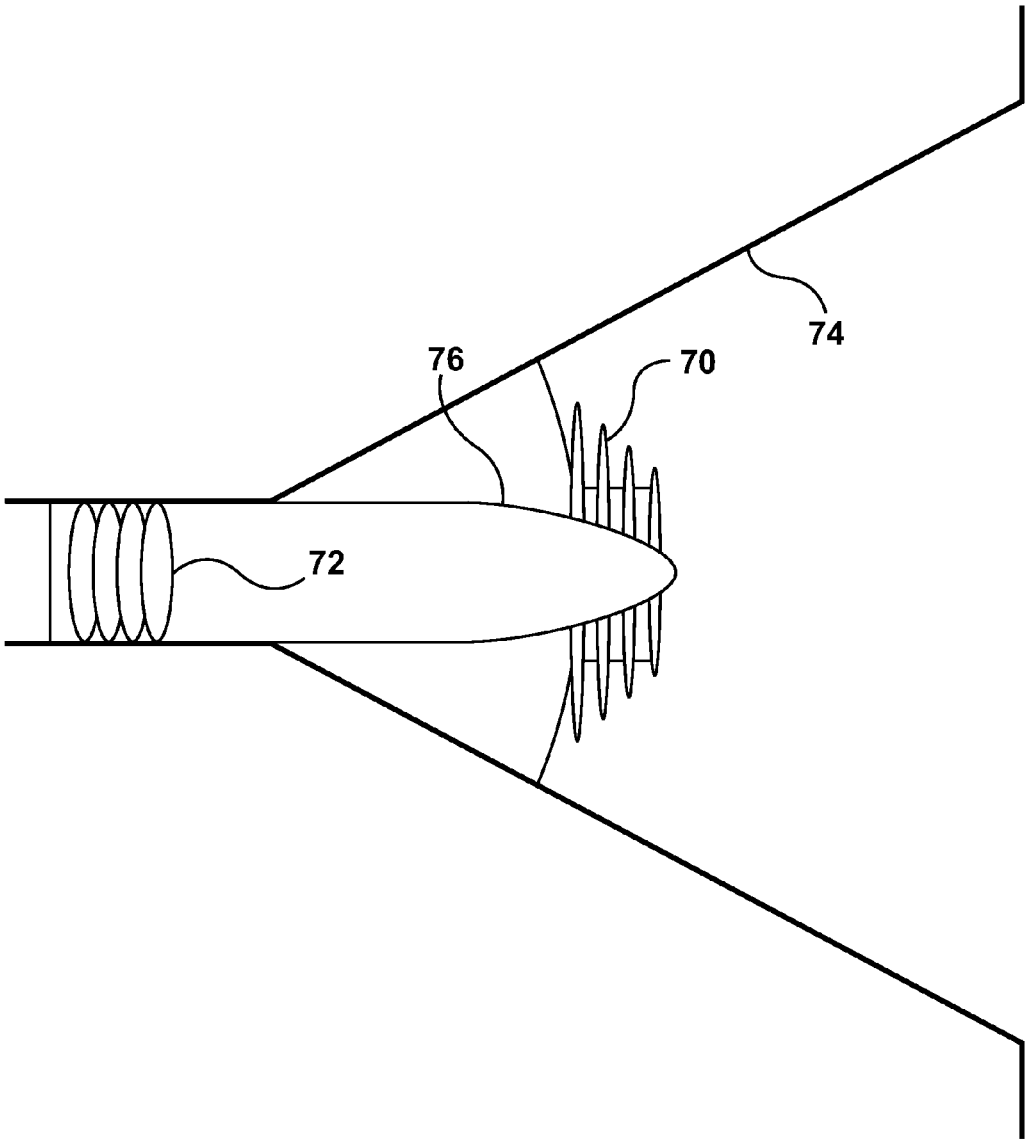
FIG. 7 illustrates a loudspeaker with a phase plug and an acoustic speaker lens that has been adapted for use in such a loudspeaker.

For a first example, illustrated in FIG. 7, a speaker driver may include a phase plug 76. The phase plug 76 may be metal or plastic and may be mounted to a speaker magnet (not shown) and may extend through the center of a voice coil 72. The phase plug 76 is a fixed device that, unlike the acoustic speaker lens 10, remains in a fixed location even while the voice coil 72 causes movement of a driver cone 74. FIG. 7 illustrates an acoustic speaker lens 70 that has been adapted for use in a loudspeaker with a phase plug. For instance, the acoustic speaker lens 70 defines an aperture leading to a hollow interior sized to receive the phase plug. The adapted acoustic speaker lens 70 then moves with the driver cone 74 to which it is adhered, back and forth over the phase plug 76.

Figure 8:
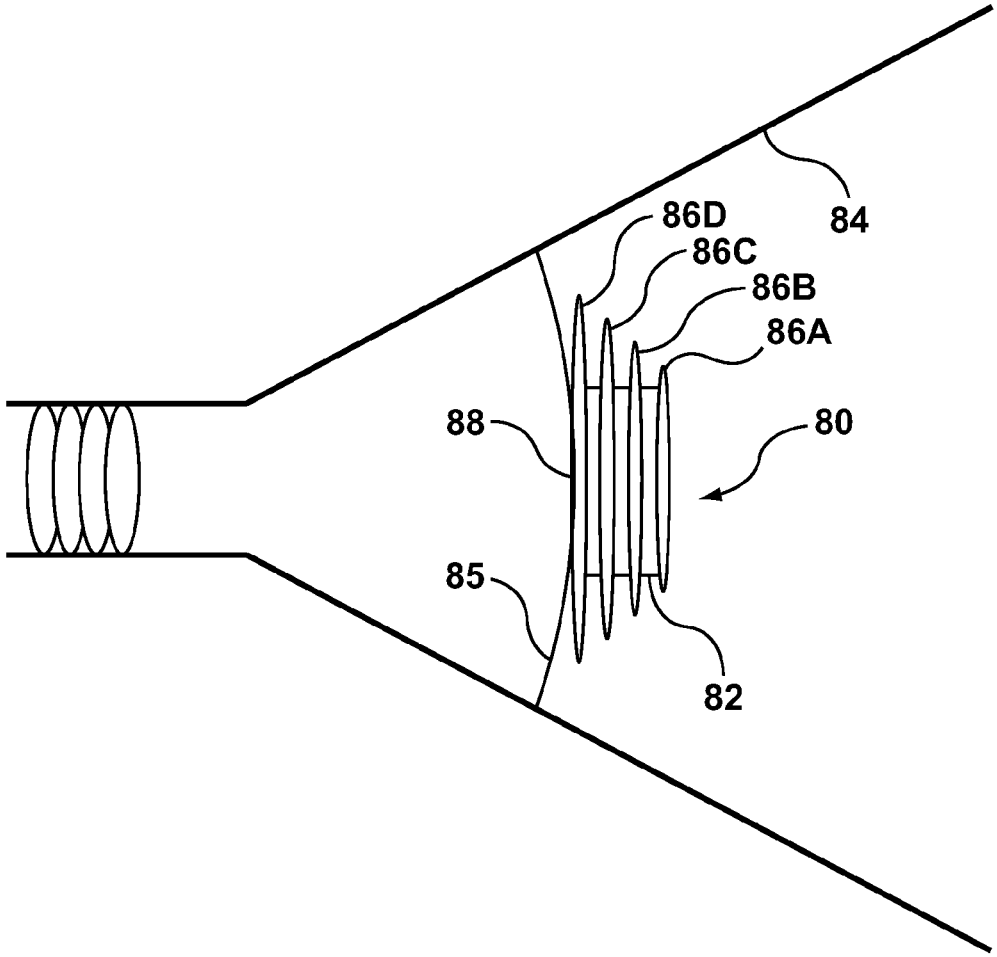
FIG. 8 illustrates an acoustic speaker lens with radially extending ribs whose dimensions gradually reduce as a distance increases between a given rib and a point at which the acoustic speaker lens attaches to a dust cap.

In a second example, illustrated in FIG. 8, a center covering 85, called a "dust cap", sits over the center of a driver cone 84, adhering to the driver cone 84 and may be part of the driver cone material itself. The dust cap 85 is designed to seal the front of the driver cone 84 and stop air from moving through the center of the driver. Occasionally, the dust cap 85 on a loudspeaker requires replacement. It is contemplated herein that an acoustic speaker lens 80 may be affixed to a replacement dust cap 85 such that installing an acoustic speaker lens on a loudspeaker is as straightforward for the user as replacing the dust cap.

The acoustic speaker lens 80 illustrated in FIG. 8 differs from the acoustic speaker lens 10 of FIGS. 1-6. Extending radially outward from a center post 82 are four discs: a front rib 86A; a forward middle rib 86B; a rear middle rib 86C; and a rear rib 86D (collectively or individually referenced by reference numeral 86). The radially extending ribs 16 of the acoustic speaker lens 10 of FIGS. 1-6 are illustrated as having consistent dimensions. In contrast, the acoustic speaker lens 80 of FIG. 8 has radially extending ribs 86 whose dimensions gradually decrease as a distance increases between a given rib 86 and a point 88 at which the acoustic speaker lens 80 attaches to the dust cap 85. That is, the front rib 86A is smaller than the forward middle rib 86B, which is smaller than the rear middle rib 86C, which is smaller than the rear rib 86D.

Figure 9:
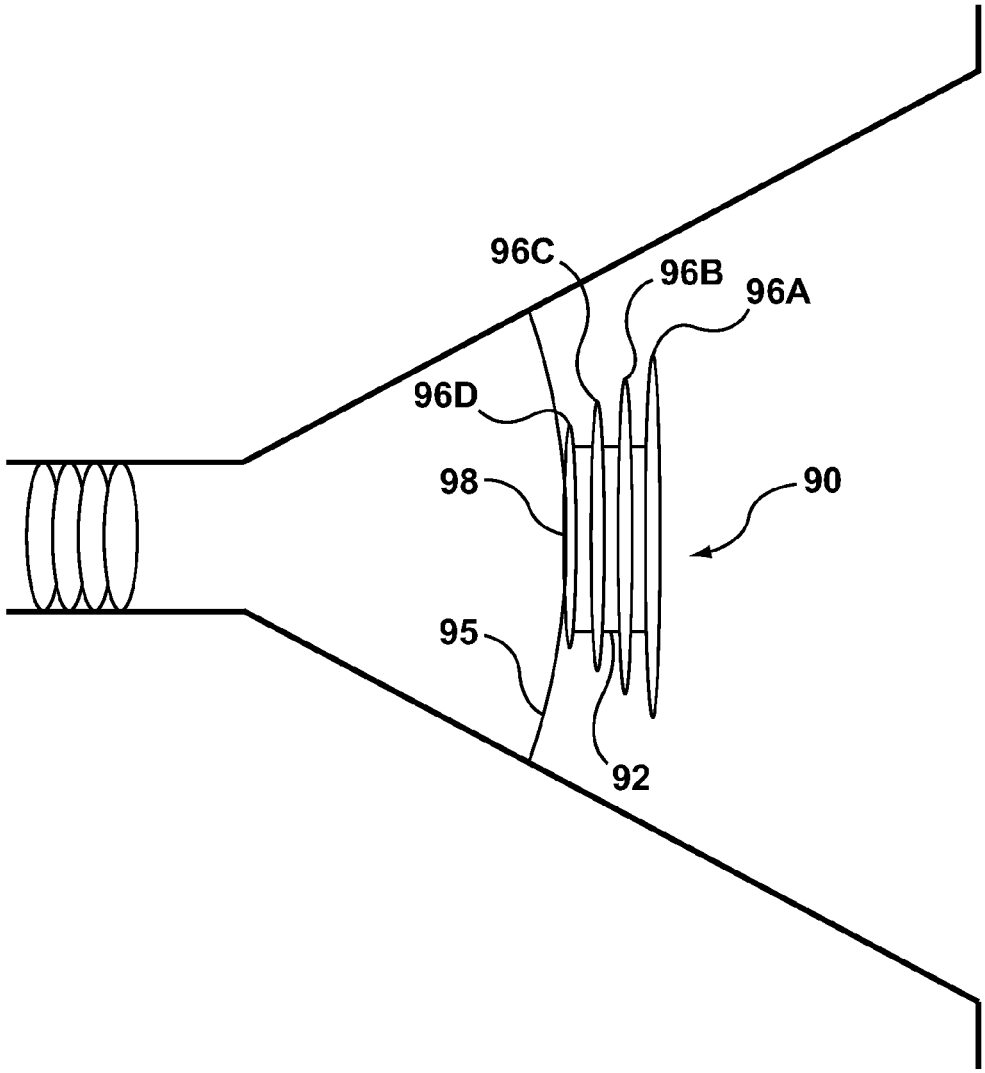
FIG. 9 illustrates an acoustic speaker lens with radially extending ribs whose dimensions gradually increase as a distance increases between a given rib and a point at which the acoustic speaker lens attaches to a dust cap.

In a further alternative, illustrated in FIG. 9, an acoustic speaker lens 90 has, extending radially from a center post 92, ribs including: a front rib 96A; a forward middle rib 96B; a rear middle rib 96C; and a rear rib 96D (collectively or individually referenced by reference numeral 96). In contrast, to the gradually decreasing dimensions of the ribs 86 of the acoustic speaker lens 80 of FIG. 8, the dimensions of the ribs 96 of the acoustic speaker lens 90 of FIG. 9 gradually increase as a distance increases between a given rib and a point 98 at which the acoustic speaker lens 90 attaches to a dust cap 95. That is, the front rib 96A is larger than the forward middle rib 96B, which is larger than the rear middle rib 96C, which is larger than the rear rib 96D.

Notably, when the acoustic speaker lens 80 is mounted to the dust cap 85, the acoustic speaker lens 80 may be arranged to sit perfectly centered, in the middle of the driver cone 84. Beneficial properties for the material from which the acoustic speaker lens may be formed include those materials with low mass but high strength, so as not to flex. One proposed material with such properties is titanium, which is very light, yet very strong.

While, thus far, it has been discussed that the acoustic speaker lens and the driver cone are distinct elements. It is proposed herein that the acoustic speaker lens may be formed at the same time as the driver cone and of the same material, so that the acoustic speaker lens and the driver cone are integral with each other. Alternatively, the acoustic speaker lens may be integral with a driver cone dust cap.

Figure 10:
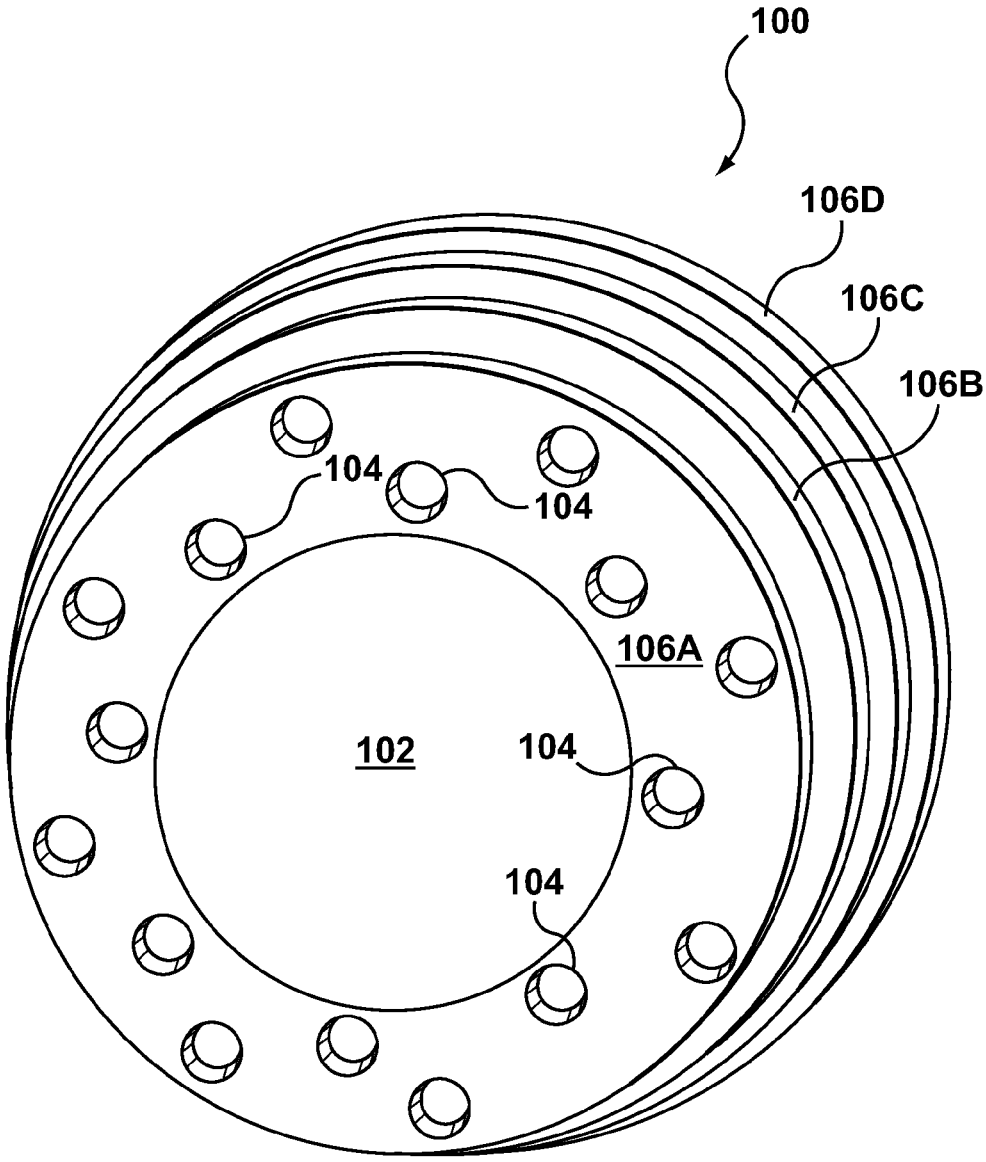
FIG. 10 illustrates an acoustic speaker lens having a front rib with apertures.

FIG. 10 illustrates an acoustic speaker lens 100 including a center post 102. Extending radially outward from the center post 102 are four discs: a front rib 106A; a forward middle rib 106B; a rear middle rib 106C; and a rear rib 106D (collectively or individually referenced by reference numeral 106). Similar to the acoustic speaker lens 80 of FIG. 8, the acoustic speaker lens 100 of FIG. 10 has ribs 106 with dimensions that gradually decrease with distance away from an attachment point. That is, the front rib 106A is smaller than the forward middle rib 106B, which is smaller than the rear middle rib 106C, which is smaller than the rear rib 106D. Notably, the front rib 106A of the acoustic speaker lens 100 of FIG. 10 has 16 apertures 104. Conveniently, the apertures 104 may be considered to reduce the overall weight of the acoustic speaker lens 100 as well as reduce the amount of air resistance and reflections without significantly effecting the strength of the acoustic speaker lens 100.

Figure 11:
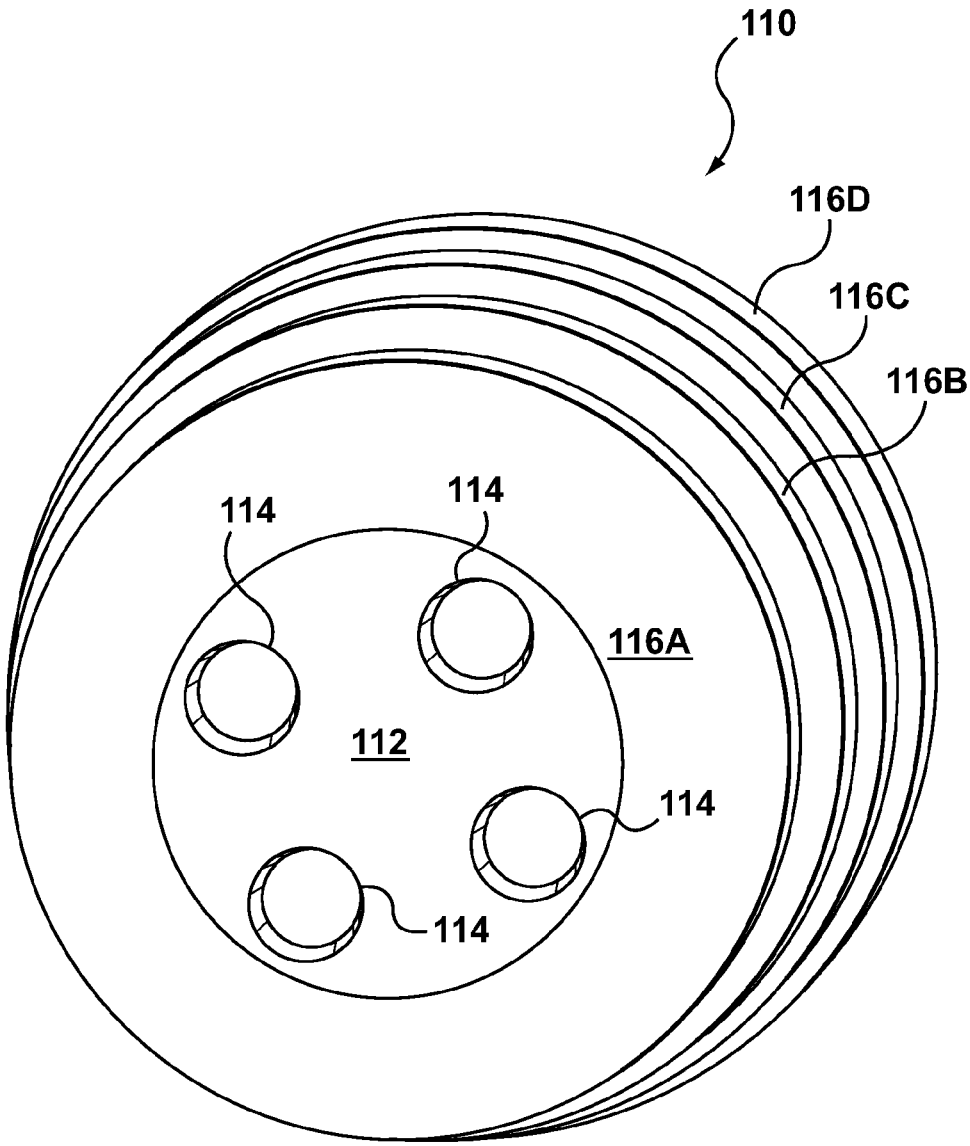
FIG. 11 illustrates an acoustic speaker lens having a centre post with apertures.

FIG. 11 illustrates an acoustic speaker lens 110 including a center post 112. Extending radially outward from the center post 112 are four discs: a front rib 116A; a forward middle rib 116B; a rear middle rib 116C; and a rear rib 116D (collectively or individually referenced by reference numeral 116). Similar to the acoustic speaker lens 100 of FIG. 10, the acoustic speaker lens 110 of FIG. 11 has ribs 116 with dimensions that gradually decrease with distance away from an attachment point. Notably, the center post 112 of the acoustic speaker lens 110 of FIG. 11 has 4 apertures 114. Conveniently, the apertures 114 may be considered to reduce the overall weight of the acoustic speaker lens 110 as well as reduce the amount of air resistance and reflections without significantly effecting the strength of the acoustic speaker lens 110.

Figure 12:
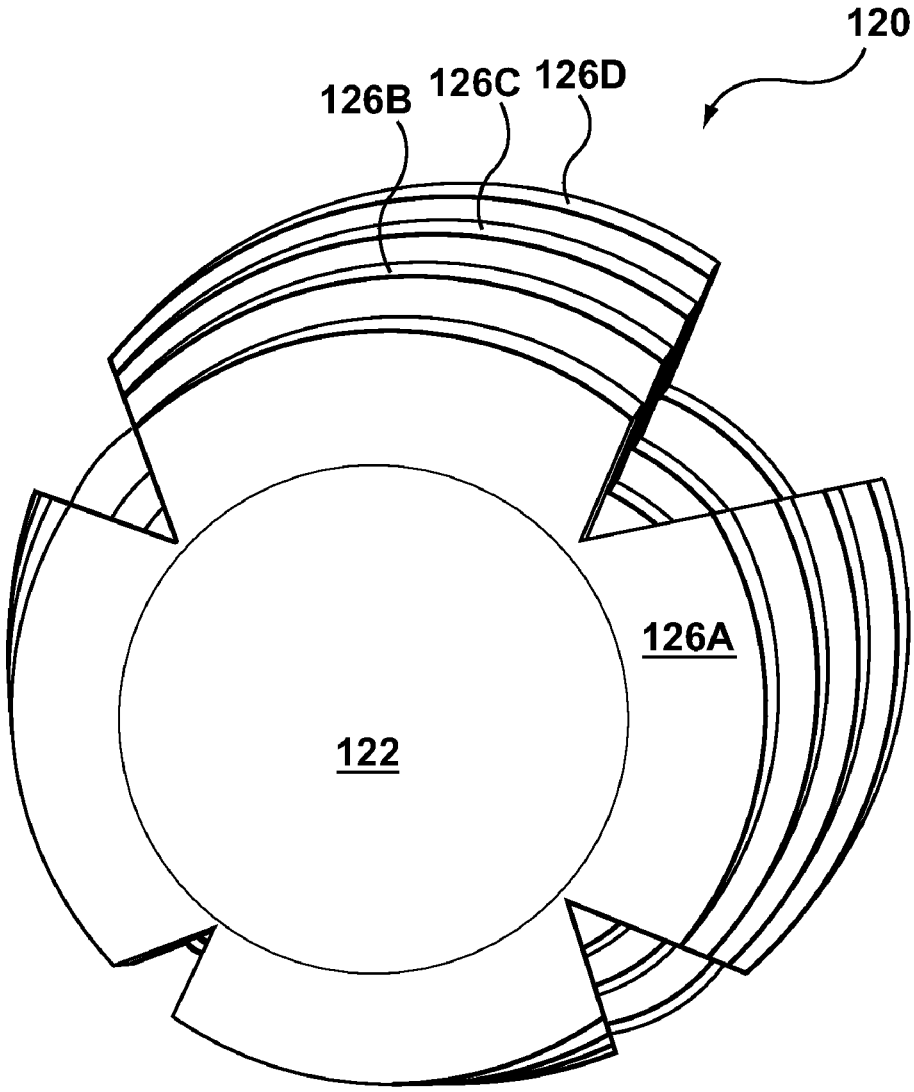
FIG. 12 illustrates an acoustic speaker lens having ribs with missing sections.

FIG. 12 illustrates a further acoustic speaker lens design option. In particular, FIG. 12 illustrates an acoustic speaker lens 120 including a center post 122. Extending radially outward from the center post 122 are four discs: a front rib 126A; a forward middle rib 126B; a rear middle rib 126C; and a rear rib 126D (collectively or individually referenced by reference numeral 126). Similar to the acoustic speaker lens 80 of FIG. 8, the acoustic speaker lens 120 of FIG. 12 has ribs 106 with dimensions that gradually decrease with distance away from an attachment point. That is, the front rib 126A is smaller than the forward middle rib 126B, which is smaller than the rear middle rib 126C, which is smaller than the rear rib 126D. Notably, each of the ribs 126 in the acoustic speaker lens 120 of FIG. 12 has four triangular sections missing. Conveniently, the missing sections may be considered to reduce the overall weight of the acoustic speaker lens 120 as well as reduce the amount of air resistance and reflections without significantly effecting the strength of the acoustic speaker lens 120.

Figure 13:
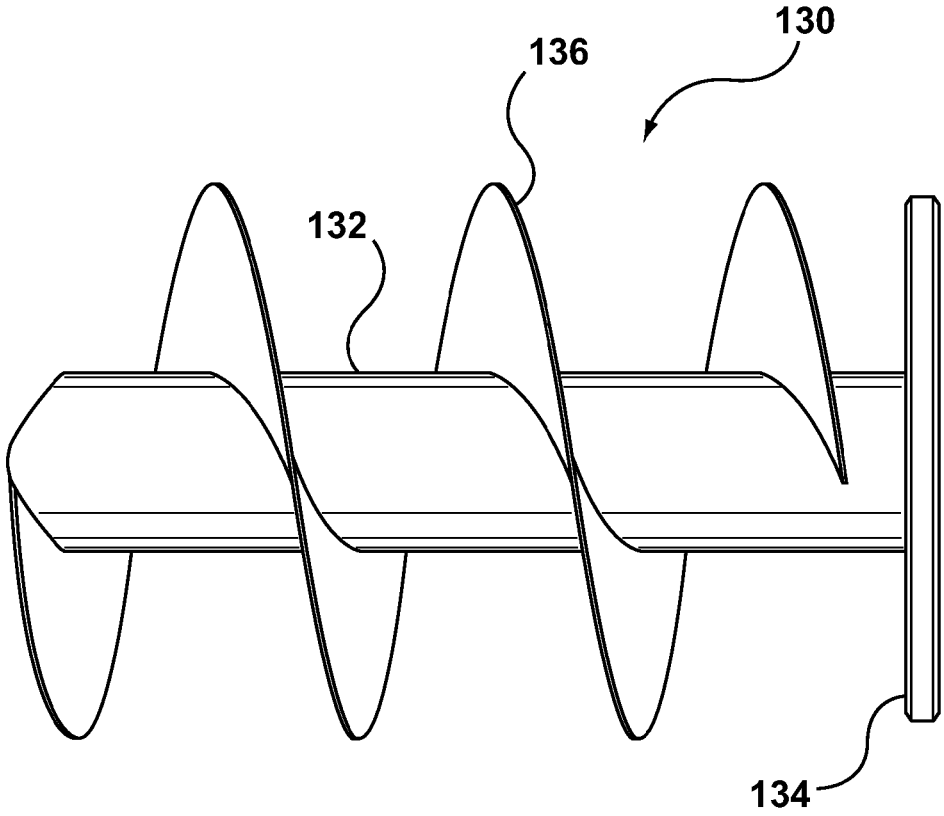
FIG. 13 illustrates an acoustic speaker lens having a spiral rib design.

FIG. 13 illustrates a further acoustic speaker lens design option. In particular, FIG. 13 illustrates a screw-type acoustic speaker lens 130 including a center post 132. The center post 132 extends outward from a base 134. The base 134 may be used for fastening the acoustic speaker lens 130 to a driver cone or a dust cap. The screw-type acoustic speaker lens 130 is characterized by a helical rib 136 wrapped around the center post 132. Rather than the plurality of ribs 86 of the acoustic speaker lens 80 of FIG. 8, the acoustic speaker lens 130 of FIG. 13 has the single, helical rib 136.

The helical rib 136 of the acoustic speaker lens 130 of FIG. 13 has an edge that is a constant distance from the surface of the center post 132. However, it is contemplated that the distance between the edge of the helical rib 136 and the surface of the center post 132 may change over the length of the center post 132, either tapering away from the base 134, in a manner similar to the structure of the acoustic speaker lens 80 of FIG. 8, or tapering toward the base 134, in a manner similar to the structure of the acoustic speaker lens 90 of FIG. 9.

As will be clear to a person of ordinary skill in the art, loudspeakers are manufactured in a wide range of sizes and the same sized acoustic speaker lens will not be optimum for every size of driver cone. Acoustic speaker lenses of various masses, materials, and rib diameters may be experimented with for a driver cone with given dimensions.

The above-described embodiments of the present application are intended to be examples only. Alterations, modifications and variations may be effected to the particular embodiments by those skilled in the art without departing from the scope of the application, which is defined by the claims appended hereto.

What is claimed is:

1. A loudspeaker comprising:
a cabinet defining an aperture;
a driver cone mounted within said aperture; and
an acoustic speaker lens positioned on said driver cone, said acoustic speaker lens including:
a center post; and
a plurality of ribs extending radially outward from said center post.

2. The loudspeaker of claim 1 wherein said acoustic speaker lens is attached to said driver cone by an adhesive.

3. The loudspeaker of claim 1 wherein said acoustic speaker lens is attached to said driver cone by a mechanical fastener.

4. The loudspeaker of claim 3 wherein said mechanical fastener comprises a screw.

5. The loudspeaker of claim 3 wherein said mechanical fastener comprises a clamp.

6. The loudspeaker of claim 1 wherein said driver cone defines a driver cone aperture and said acoustic speaker lens is attached to said driver cone by insertion of a portion of said acoustic speaker lens into said driver cone aperture.

7. The loudspeaker of claim 1 wherein said acoustic speaker lens is integral to said driver cone.

8. The loudspeaker of claim 1 further comprising a phase plug, wherein said acoustic speaker lens defines a lens aperture leading to a hollow interior sized to receive said phase plug.

9. The loudspeaker of claim 1 further comprising a dust cap mounted to said driver cone as a covering for an apex of said driver cone.

10. The loudspeaker of claim 9 wherein said acoustic speaker lens is attached to said dust cap by an adhesive.

11. The loudspeaker of claim 9 wherein said dust cap defines a dust cap aperture and said acoustic speaker lens is attached to said dust cap by insertion of a portion of said acoustic speaker lens into said dust cap aperture.

12. The loudspeaker of claim 11 wherein said acoustic speaker lens is integral to said dust cap.

13. The loudspeaker of claim 1 wherein each rib of said a plurality of ribs has identical dimensions.

14. The loudspeaker of claim 1 wherein each rib of said a plurality of ribs has a distinct dimension.

15. The loudspeaker of claim 14 wherein said dimension of said each rib increases with distance from said driver cone.

16. The loudspeaker of claim 14 wherein said dimension of said each rib decreases with distance from said driver cone.

17. The loudspeaker of claim 1 wherein each rib of said a plurality of ribs defines a plurality of cut-outs.

18. The loudspeaker of claim 17 wherein said plurality of cut-outs on said each rib have corresponding size and shape.

19. The loudspeaker of claim 18 wherein said plurality of cut-outs on said each rib are aligned.

20. A loudspeaker comprising:

a cabinet defining an aperture;

a driver cone mounted within said aperture, said driver cone molded to include an acoustic speaker lens, said acoustic speaker lens including:

a center post; and a plurality of ribs extending radially outward from said center post.

21. A loudspeaker comprising:

a cabinet defining an aperture;

a driver cone mounted within said aperture, said driver cone molded to include an acoustic speaker lens, said acoustic speaker lens including:

a center post; and a helical rib extending radially outward from said center post.

* * * * *